US010508854B2

(12) United States Patent
Demuth et al.

(10) Patent No.: US 10,508,854 B2
(45) Date of Patent: Dec. 17, 2019

(54) COOLING DEVICE FOR THE COOLED STORAGE OF MEDICAL PRODUCTS

(71) Applicant: B Medical Systems S.a.r.l., Hosingen (LU)

(72) Inventors: Jeannot Demuth, Eschdorf (LU); Igor Nikolajew, Klein Bettingen (LU); Nico Girrens, Rodershausen (LU); Andreas Hoffmann, Ammeldingen (DE)

(73) Assignee: B. Medical Systems, S.a.r.l., Hosingen (LU)

( * ) Notice: Subject to any disclaimer, the term of this patent is extended or adjusted under 35 U.S.C. 154(b) by 255 days.

(21) Appl. No.: 15/119,449

(22) PCT Filed: Feb. 17, 2014

(86) PCT No.: PCT/EP2014/053009

§ 371 (c)(1),
(2) Date: Aug. 17, 2016

(87) PCT Pub. No.: WO2015/120911

PCT Pub. Date: Aug. 20, 2015

(65) Prior Publication Data

US 2017/0023290 A1 Jan. 26, 2017

(51) Int. Cl.
*F25D 11/00* (2006.01)
*A61J 1/16* (2006.01)
(Continued)

(52) U.S. Cl.
CPC ..... *F25D 11/003* (2013.01); *A61J 1/165* (2013.01); *F25D 11/006* (2013.01); *F25D 21/14* (2013.01);
(Continued)

(58) Field of Classification Search
CPC ..... F25D 11/003; F25D 11/006; F25D 2303/0843; F25D 2201/10;
(Continued)

(56) References Cited

U.S. PATENT DOCUMENTS 4,528,439 A * 7/1985 Marney, Jr. ..... A45C 11/20 165/902
6,020,575 A 2/2000 Nagle et al.
(Continued)

FOREIGN PATENT DOCUMENTS

GB 2175384 A * 11/1986
GB 2175384 A * 11/1986 ..... F25D 21/14
(Continued)

OTHER PUBLICATIONS

N.N, Feb. 22, 1991, ProQuest, JPH03018473U, English translation of Drawings.*
(Continued)

*Primary Examiner* — Frantz F Jules
*Assistant Examiner* — Steve S Tanenbaum
(74) *Attorney, Agent, or Firm* — Jerold I. Schneider; Schneider IP Law

(57) ABSTRACT

The invention relates to a cooling device 1, in particular a freezer 2, having a cooling circuit 3, wherein the cooling circuit 3 has a compressor 4, at least one evaporator 5, and a condenser 44, and a closable cooling space 6 with a plurality of cooling space sidewalls 7, a cooling space base 8, at least one cooling element 9, and an insulation vessel 10. In the cooling device 1 the evaporator 5 and the cooling element 9 are disposed within the cooling space 6 such that the back of the cooling element 11 at least partially abuts on the evaporator 5 and the front of the cooling element 12 faces the insulation vessel 10, and the insulation vessel 10 is closed at least towards the at least one cooling element 9 and
(Continued)

forms a space for cooling goods 13. The back of the cooling element 11 abutting the evaporator 5 has at least one recess 14 into which at least one removable cold accumulator 15 can be inserted. Preferably in the region of the downwardly facing end 16 of the insulation vessel 10 at least one heating element 17 and at least one storage element 18 are arranged.

18 Claims, 7 Drawing Sheets

(51) Int. Cl.
*F25D 25/02* (2006.01)
*F25D 21/14* (2006.01)

(52) U.S. Cl.
CPC ..... *F25D 25/022* (2013.01); *A61J 2200/44* (2013.01); *F25D 2201/10* (2013.01); *F25D 2303/0843* (2013.01); *F25D 2303/0845* (2013.01); *F25D 2303/08221* (2013.01); *F25D 2331/804* (2013.01); *F25D 2400/02* (2013.01)

(58) Field of Classification Search
CPC ..... F25D 2303/0845; F25D 2331/804; F25D 21/06; F25D 21/065; F25D 21/14; A61J 1/165; A61J 2200/44
USPC ..... 62/457.2
See application file for complete search history.

(56) References Cited

U.S. PATENT DOCUMENTS

| | | | | |
|---|---|---|---|---|
| 2005/0006272 | A1* | 1/2005 | Derifield | B65D 81/3827 206/521 |
| 2005/0150244 | A1* | 7/2005 | Hillmann | B65D 5/566 62/371 |
| 2013/0340467 | A1 | 12/2013 | Kiedaisch et al. | |

FOREIGN PATENT DOCUMENTS

| | | | | |
|---|---|---|---|---|
| GB | 2383403 | A | | 6/2003 |
| JP | H0318473 | U | * | 2/1991 |
| JP | H0318473 | U | * | 2/1991 |
| JP | H0318473 | U | | 2/1991 |
| WO | 2013091913 | A1 | | 6/2013 |

OTHER PUBLICATIONS

International Search Report of the International Searching Authority, Application No. PCT/EP2014/053009, dated Oct. 29, 2014, 3 pages.

International Preliminary Report on Patentability, Application No. PCT/EP2014/053009, dated Feb. 3, 2016, 13 pages.

* cited by examiner

COOLING DEVICE FOR THE COOLED STORAGE OF MEDICAL PRODUCTS

The present invention relates to a cooling device, in particular a freezer, having a cooling circuit, wherein the cooling circuit has a compressor, at least one evaporator, and a condenser, and a closable cooling space with a plurality of cooling space sidewalls, a cooling space base, at least one cooling element, and an insulation vessel, wherein the evaporator and the cooling element are disposed within the cooling space such that a first side of the cooling element at least partially abuts on the evaporator and a second side of the cooling element faces the insulation vessel, and the insulation vessel is closed at least towards the at least one cooling element and forms a space for cooling goods.

Usually, such cooling devices are employed in remote areas, in particular in developing countries, where a stable and safe and continuous energy supply, for example via a power supply system, cannot be ensured. Nevertheless, above all just in these areas, where often also extreme climatic conditions prevail, an uninterrupted cold chain for food and in particular medical products, such as for example vaccines or blood conserves, is indispensable. In particular, handling and storing the latter products under the manufacturer's conditions to be met to achieve the usability and efficacy of the products is often difficult, what is considered to be one of the causes for the extremely poor living conditions of the people living there and significantly contributes to the high mortality rate.

Therefore, the World Health Organization (WHO) has made a catalogue with threshold criteria, which have to be fulfilled by the used cooling equipment for the transport and storage of medical products. Thus, for the transport for short routes thus in particular insulation boxes with ice bags, or so-called freeze packs have established with which the required cooling of the stored substances at least during the short transport can be ensured. For the storage of medical products more stringent requirements arise. So, the cooling temperature in particular for various vaccines must not be higher than +8° C. and not less than +2° C. Further, even upon failure of the power supply sufficient cooling for at least three days must be ensured. Thus, in particular electrical cooling apparatus with and without cooling elements, or battery-driven cooling elements are possible. Here, it has been found to be feasible to generate the power required for operation in a photovoltaic manner since the solar insolation in most developing countries is sufficiently high throughout the year.

The failure of power supply as is regularly occurring with a photovoltaically operated cooling device during the solar insolation-free time (e.g. at night or in case of clouds), but also the requirement to be able to transport medical products in cold boxes over land, for example requires the production of ice with which the cooling goods can be cooled during the energy-free time or transport, respectively. In order to effectively freeze water, for example a temperature is required that is well below under 0 degrees Celsius to ensure a sufficient subzero cooling of the water, and thus a fast ice formation. Temperatures of less than −6° Celsius have proven to be particularly effective. However, since these are well below the minimum value of +2° Celsius required by the WHO for storing medical goods, the cooling devices known in the prior art in addition to a cooling space for the products to be stored have a freezing room to produce the ice bags or freeze packs. Here, the cooling space and the freezing room are cooled by separate cooling circuits. Here, the cooling space or further cooling spaces are used to store the medical products and the freezer room is used to sufficiently produce ice to fill in the energy-free time.

For example, so-called SDD cooling apparatus (Solar-Direct-Drive) are known wherein auxiliary batteries as a buffering provide the cooling apparatus at night and on sunless days with energy. Usually, the energy is used to operate an internal fan that brings "cold" from an ice accumulator into the space for cooling goods during the energy-free time, or to operate a heating system that prevents falling below the minimum temperature.

These systems have proven to be extremely practicable in longstanding field experiments. However, due to the additionally required freezing room for the production of ice bags or freeze packs in these systems the storage capacity for medical products is restricted accordingly. Moreover, it has proven to be a problem that the auxiliary batteries for power supply only have a limited lifetime and a renewal causes high costs and logistics. Further, an improper disposal of used batteries causes environmental problems. Additionally, a plurality of additional components, for example fans and regulating components, is required, the spare supply and maintenance of which sometimes cause problems due to the secluded location in which these products are employed. Additionally, the additional components enlarge the dimensions of the cooling device, the weight as well as the power demand of the cooling device.

Printed matter WO 2013/091913 A1 describes a cooling device. The cooling device comprises at least one cooling circuit, the cooling circuit having a compressor, an evaporator, and a condenser, and a closable cooling space with a plurality of cooling space sidewalls, a cooling space base, and a space for cooling goods, and at least one cooling element. The evaporator and the cooling element are disposed in the cooling space such that the back of the cooling element abuts on the evaporator and the front faces the space for cooling goods.

Printed matter US 2013/0340467 A1 describes a passive cold box. Inner sidewalls of the cold box comprise receiving regions that are provided for receiving cool batteries.

Printed matter GB 2 383 403 A describes an insulation box. A heating panel that is connected to a control circuit is disposed on an inner sidewall of the insulation box.

Thus, it is the problem of the present invention to provide a cooling device that has an extended storage capacity in combination with a compact, reliable and simple construction and at the same time can comply with the above-described criteria and objectives.

The solution of the problem is accomplished with a cooling device according to claim 1. Practical developments are described in the dependent claims.

The cooling device according to the invention in contrast to the cooling devices known from the prior art is characterized in that the first side of the cooling element abutting the at least one evaporator has at least one recess into which at least one removable cold accumulator can be inserted, and further in that the insulation vessel preferably in the region of its downwardly facing end has at least one heating element and at least one storage element. As the cooling element and/or removable cold accumulator such elements are suitable that once they are cooled can receive a large amount of energy without hereby the own temperature being significantly increased. The described development of the cooling element is advantageous in that removable cold accumulators required for the transport of medical products are cooled and then stored within the cooling space until freezing of the content, in which also the cooling elements are cooled that in case of a failure of power supply cool the space for cooling goods in the interior of the cooling device and the products stored therein. Since the at least one recess into which the at least one removable cold accumulator can be inserted is disposed on the first side of the cooling element that abuts on the at least one evaporator also the at least one removable cold accumulator can directly abut on the at least one evaporator over a large area, whereby a good energy flow from the at least one removable cold accumulator to the at least one evaporator is given. Thus, a fast freezing of the content is achieved and the at least one removable cold accumulator is quickly ready to be removed and used. A further important advantage of the claimed cooling device is that the space for cooling goods having the at least one heating element that is preferably provided in the region of the downwardly facing end of the insulation vessel and the at least one storage element can be uniformly tempered, since the heat generated there can rise from the bottom to the top in the space for cooling goods. In this way it can be ensured that in the interior of the space for cooling goods there is always a temperature within the required range of preferably +2° to +8° Celsius, in particular when the content of the at least one cold accumulator is frozen and supplies an additional cold flow to the space for cooling goods. Therefore, the cooling device according to the invention provides a compact and simple construction with an extended storage capacity and small dimensions that with only one cooling circuit both ensures freezing and storing of the removable cold accumulators and also storing of sensible cooling goods or vaccines within the required temperature limits in the space for cooling goods. In addition, since during the energy-free time in particular the at least one storage element avoids excessive cooling of the space for cooling goods it can also be refrained from auxiliary batteries for the operation of a heating system. This in turn increases the cooling device's safety of operation and solves the disposal problem of the auxiliary batteries.

In a suitable development of the cooling device the region within the cooling space and outside of the space for cooling goods forms a freezing zone and the space for cooling goods forms a cooling zone in which cooling goods to be cooled can be deposited. By the insulation vessel as well as the at least one heating element and/or the at least one storage element this is protected against excessive cooling. Here, by a freezing zone there is understood a region in which the temperature is significantly below the freezing point as long as the cooling device is provided with energy. On the other hand, the cooling zone corresponds to the space for cooling goods in which an optimum temperature required for the storage of the cooling goods prevails in the cooling device. However, forming the cooling space as freezing zone is advantageous in that the at least one cooling element disposed there on the evaporator and/or the at least one removable cold accumulator can be cooled strongly and directly, as long as energy for the cooling device is available. In the following, during the energy-free time period, the at least one cooling element and/or the at least one removable cold accumulator then can cool the space for cooling goods the longer the stronger the at least one cooling element and/or the at least one removable cold accumulator have previously been cooled. Here, the temperature in the space for cooling goods can advantageously be controlled by the interaction of at least the insulation vessel as well as the at least one heating element and/or the at least one storage element, preferably be adjusted in the range of a defined minimum temperature.

In a suitable development the at least one heating element may preferably be electrically operated and have a control. This ensures that there is no falling below a required minimum temperature in the space for cooling goods. Since the operation of a cooling device according to the invention especially takes place in developing countries an electrically operated heating element suggests itself, since so the heating element and the cooling device there as an alternative to mains current can also be operated with alternative energy sources, for example photovoltaically or with wind power.

Furthermore, it is advantageous if the at least one storage element is preferably formed as latent-heat storage tank that is designed such that it emits the stored thermal energy into the space for cooling goods in case of falling below the required minimum temperature. This ensures that there is no falling below a required minimum temperature in the space for cooling goods. The latent-heat storage tank according to the invention is characterized in that it is filled with a phase-change material that changes from the liquid to a crystalline state at a material-specific temperature and emits heat of crystallization. By suitably selecting the phase-change material the latent-heat storage tank can be formed such that the phase-change material therein crystallizes in case of falling below the required minimum temperature and emits heat of crystallization into the space for cooling goods. Since the crystallization of the phase-change material is only temperature-depending the at least one storage element can prevent the fall below the required minimum temperature also during an energy-free time. A further advantage of using a latent-heat storage tank is that the crystallization of the phase-change material is reversible. That is, by the supply of energy the crystals formed upon cooling can be dissolved and the latent-heat storage tank can be restored to its initial state. With the cooling device according to the invention charging the latent-heat storage tank can be done by the at least one heating element that is preferably disposed below the at least one latent-heat storage tank. Since during melting of the phase-change material the temperature of the latent-heat storage tank does not significantly increase the use of a latent-heat storage tank also avoids a too high heat supply into the space for cooling goods during the operation of the at least one heating element.

It is advantageous for the operation of the cooling device that the cooling goods in the space for cooling goods are stored in a storing facility, preferably in the form of a grid basket. The storage facility prevents a direct contact of the cooling goods with the insulation vessel as well as with the at least one heating element and the at least one storage element. Moreover, taking out the cooling goods is made easier. Since the insulation vessel separates the cooling zone from the freezing zone there may locally be temperatures in the space for cooling goods on the surface of the insulation vessel as a result of the energy flow through the insulation vessel that are below the required minimum temperature. The use of the storage facility, preferably in the form of a grid basket for the storage of the cooling goods prevents a direct contact of the cooling goods with the insulation vessel and the associated fall below the required minimum temperature in the cooling goods. A contact of the cooling goods with the at least one heating element and the at least one storage element is also effectively avoided since a local heating of the at least one heating element and the at least one storage element can cause that the cooling goods are heated too much upon contact. As far as that goes, the use of the storage facility for the storage of the cooling goods in the space for cooling goods promotes a uniform temperature control of the cooling goods.

Suitably, in a development of the cooling device according to the invention the cooling goods are stored spaced apart from the at least one heating element and/or the at least one storage element by a spacer grid that can be inserted within the space for cooling goods. Such an arrangement ensures that the cooling goods have no direct contact with the at least one heating element and/or with the at least one storage element. This not only avoids local overheating of the cooling goods, but a uniform distribution of the heat in the space for cooling goods is achieved if said space is cooled too much by the freezing zone. Further, providing a spacer grid according to the invention prevents the unauthorized removal of the at least one heating element and/or the at least one storage element. This prevents an incorrect operation, for example a mix-up of the at least one heating element and/or the at least one storage element with a removable cold accumulator and as a result, prevents that the temperature in the space for cooling goods can fall below the minimum temperature.

Moreover, it has proven to be suitable that the at least one cooling element and/or the at least one removable cold accumulator can be filled with a substance, preferably a liquid such as water or a eutectic medium. These well controllable media allow a safe and easy handling and ensure the desired function also in remote areas and under the most adverse circumstances. In a further development, the at least one cooling element and/or the at least one removable cold accumulator can be dischargeable and refillable via a re-closable opening. For that, the at least one cooling element and/or the at least one removable cold accumulator is preferably formed as a hollow body. Due to the re-closability of the opening it is not necessary to fill the at least one cooling element and/or the at least one removable cold accumulator already at the factory. This can be done at any time on the site of operation, for example with water. Hereby, the transportation weight of the cooling device during the transport to the site of operation of the cooling device can be considerably reduced. The use of water as the cooling liquid is further advantageous in that water is usually also available in remote areas in developing countries. In addition, water has good cold accumulator properties, in particular because the specific enthalpy of fusion of water is many times the amount of the specific heat capacity and thus, can cool the space for cooling goods in the interior of the cooling device over a long time by its melting even if there is no energy available for the operation of the cooling device. Further, by adding salts to the water a eutectic medium can be produced that has a much lower freezing point than pure water. This is particularly of interest when the desired minimum temperature in the space for cooling goods is to be under zero degrees Celsius.

According to a suitable development of the cooling device according to the invention the volume of the at least one cooling element and/or the at least one removable cold accumulator can be chosen such that after filling the at least one cooling element and/or the at least one removable cold accumulator with the predefined amount of the substance there inevitably results a dead volume serving as an expansion space for the freezing substance. It may further be advantageous for filling the at least one cooling element and/or the at least one removable cold accumulator if the re-closable opening is vertically arranged at the at least one cooling element and/or the at least one removable cold accumulator such that during filling there inevitably results the required dead volume. Here, this serves as an expansion space for the freezing water or eutectic medium and effectively prevents from overfilling. Hereby, a deformation of the at least one cooling element and/or the at least one removable cold accumulator upon freezing of the water or the eutectic medium and thus, a deterioration of the heat conduction to the evaporator of the cooling device is avoided.

It may be advantageous, if the at least one removable cold accumulator can be inserted into and removed from the at least one recess of the at least one cooling element with a cold accumulator holder. The use of a cold accumulator holder facilitates removal and re-insertion of the at least one removable cold accumulator, since in the frozen state it can often be surrounded by a thin layer of ice making the surface particularly smooth and slippery and thus, complicates a manipulation by the user.

A suitable development of the cooling device is characterized in that the cold accumulator holder is formed as an elastic spring element such that the cold accumulator holder serves to make one first side of the at least one removable cold accumulator abutting on the at least one evaporator in a resiliently manner at least over a part of the surface, preferably over the whole surface. This arrangement ensures the greatest possible contact surface between the at least one removable cold accumulator and the evaporator. As a result, cooling of the at least one removable cold accumulator by the at least one evaporator is improved.

In a suitable development of the cooling device the cold accumulator holder can have a holding portion at its upper end at which the cold accumulator holder can be manipulated and held, respectively by the user of the cooling device to insert the at least one removable cold accumulator into the at least one recess or take it out of it. The holding portion at the upper end of the cold accumulator holder facilitates the removal of the at least one removable cold accumulator when it is inserted together with the cold accumulator holder in the at least one recess of the at least one cooling element.

In a suitable development of the cooling device the at least one cooling element at its upper edge and/or lower edge may have at least one recess for receiving at least one holding means. Here, the holding means is preferably formed as an elastic spring element such that the holding means serves to make the first side of the at least one cooling element abutting on the at least one evaporator in a resiliently manner at least over a part of the surface, preferably over the whole surface. The resilient attachment of the at least one cooling element at the evaporator effectively prevents a deformation of the evaporator upon freezing of the at least one cooling element. At the same time, during the subsequent thawing by the spring force in turn there is ensured a direct and continuous contact to the evaporator. Accordingly, cooling of the at least one cooling element by the at least one evaporator is improved.

It is appropriate that the at least one recess for receiving the at least one cooling element has inclined lateral surfaces and an inclined bottom surface. Thus, possibly occurring condensed water surely flows off to the deepest point of the at least one recess and cannot dam up in the at least one recess. The inclined lateral surfaces and the inclined bottom surface cause that in the operation of the cooling device with numerous freeze and thawing cycles no moisture from the air can collect on the cold surfaces of the at least one cooling element and/or the at least one removable cold accumulator in the form of condensed water. Rather, it can flow off downwards in a controlled manner. By the targeted and controlled flowing-off of the condensed water freezing up of the at least one removable cold accumulator in the at least one recess can effectively be prevented.

Suitably, the first side of the cooling element has at least one preferably vertically arranged groove through which the condensed water occurring in the at least one recess preferably can flow off downwards. Here, the inclined lateral surfaces and the inclined bottom surface incline towards the groove to ensure the complete drain of the condensed water. Hereby, during the operation of the cooling device with numerous freeze and thawing cycles collection of the occurring condensed water at the lower end of the at least one recess as well as freezing up of the at least one removable cold accumulator is effectively prevented.

Preferably, in accordance with a further suitable development of the cooling device according to the invention the at least one cooling element can be secured by means of a covering frame that can be attached to the upper edge of the cooling space. Here, the covering frame has at least one opening for the access to and removal of the at least one removable cold accumulator. Moreover, the covering frame is also connected to the insulation vessel so that a heat transfer from the cooling zone into the freezing zone is avoided.

A suitable embodiment of the cooling device according to the invention is described with respect to the following drawings wherein FIG. 1 shows a perspective view of a cooling device according to the invention;

Figure 1:
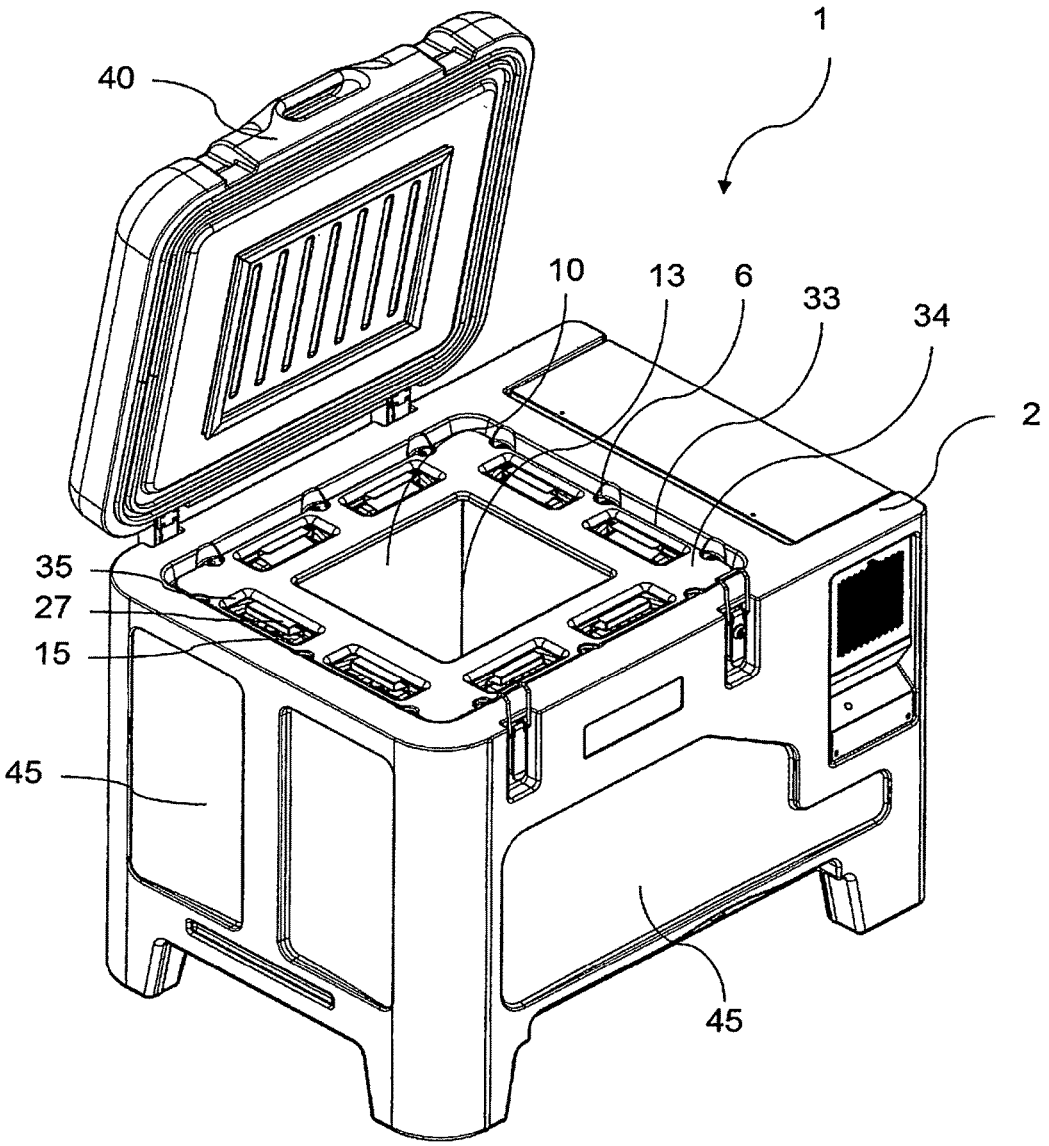

The cooling device 1 according to the invention shown in FIG. 1 is in the form of a freezer 2. However, further types of the cooling device are conceivable, for example as refrigerator. The freezer 2 is composed of a freezer body 45 that ends with a lid 41 and can be closed therewith. Within the freezer 2 there is a cooling space 6. In addition, the freezer 2 has an insulation vessel 10 that is disposed inside the cooling space 6 and that separates the space for cooling goods 13 from the cooling space 6. The area between the insulation vessel 10 and the cooling space 6 ends in a covering frame 34 at the upper edge of the cooling space 33. The covering frame 34 further has a plurality of openings 35 through which a removable cold accumulator 15 can be removed by means of a cold accumulator holder 27. Deviating from the illustrated embodiment, the cooling device 1 may also have more or less openings 35 and removable cold accumulators 15 with the covering frame 34 then having the number of openings 35 that corresponds to the number of removable cold accumulators 15.

Figure 2:
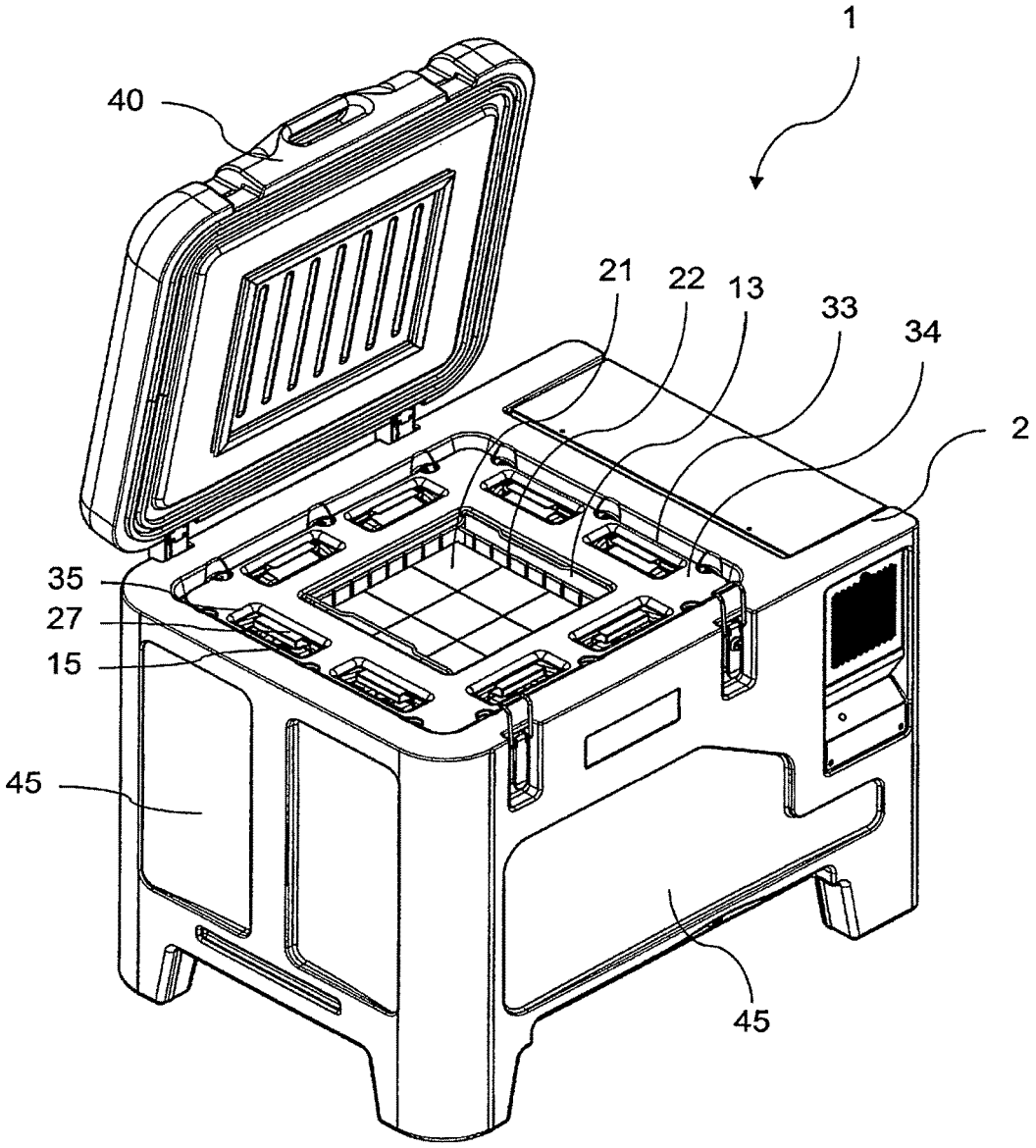
FIG. 2 shows a perspective view of a cooling device according to the invention with cooling goods.

FIG. 2 shows the embodiment of a cooling device 1 illustrated in FIG. 1 wherein in the space for cooling goods 13 a storage facility, in the present example in the form of a grid basket 22, is inserted. The storage facility may also be in the form of a tableau or a similar suitable form. The storage facility is removable. The cooling goods 21 (schematic view) are inserted into the storage facility.

Figure 3:
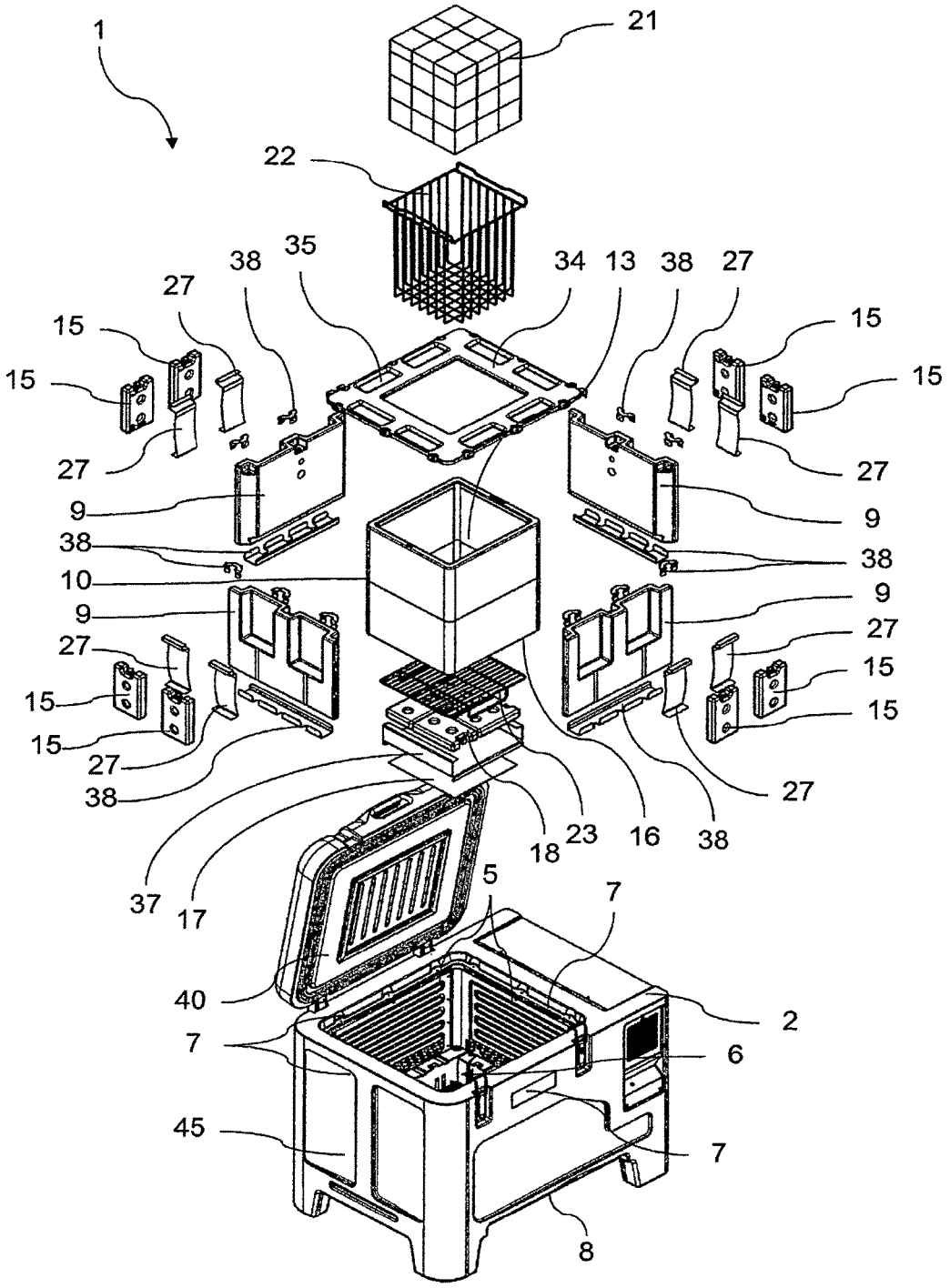
FIG. 3 shows an exploded view of the cooling device according to the invention.

The cooling device 1 according to the invention of FIG. 3 consists of a freezer 2 that has a cooling space 6 that is bounded by four cooling space side walls 7, the cooling space base 8 as well as a closable lid 40. On the surface of the cooling space sidewalls 7 facing the cooling space 6 an evaporator 5 is arranged such that it covers the surface of the cooling space sidewalls 7 facing the cooling space 6. Altogether, the cooling device 1 shown in the example has an evaporator 5. Moreover, the cooling device 1 has four cooling elements 9. These are attached on the surface of the evaporator 5 by holding clamps 38 in the mounted state. Further, the cooling space 6 of the present example has eight removable cold accumulators 15 and eight accompanying cold accumulator holders 27. However, also other numbers are conceivable. According to the number of removable cold accumulators 15 eight openings 35 are provided in the covering frame 34. Further, the space for cooling goods 13 is separated from an insulation vessel 10 that is closed towards the four cooling elements 9. The upper and lower ends of the insulation vessel 10 have openings. In the region of the lower end of the insulation vessel 10 a spacer grid 23 is arranged. Four storage elements 18 are provided on a receiving plate 37 below the spacer grid 23. Further, a heating element 17 is provided below the receiving plate 37. For receiving the cooling goods 21 the cooling device 1 has the storage facility in the form of a grid basket 22 that is inserted into the cooling space 13.

Figure 4:
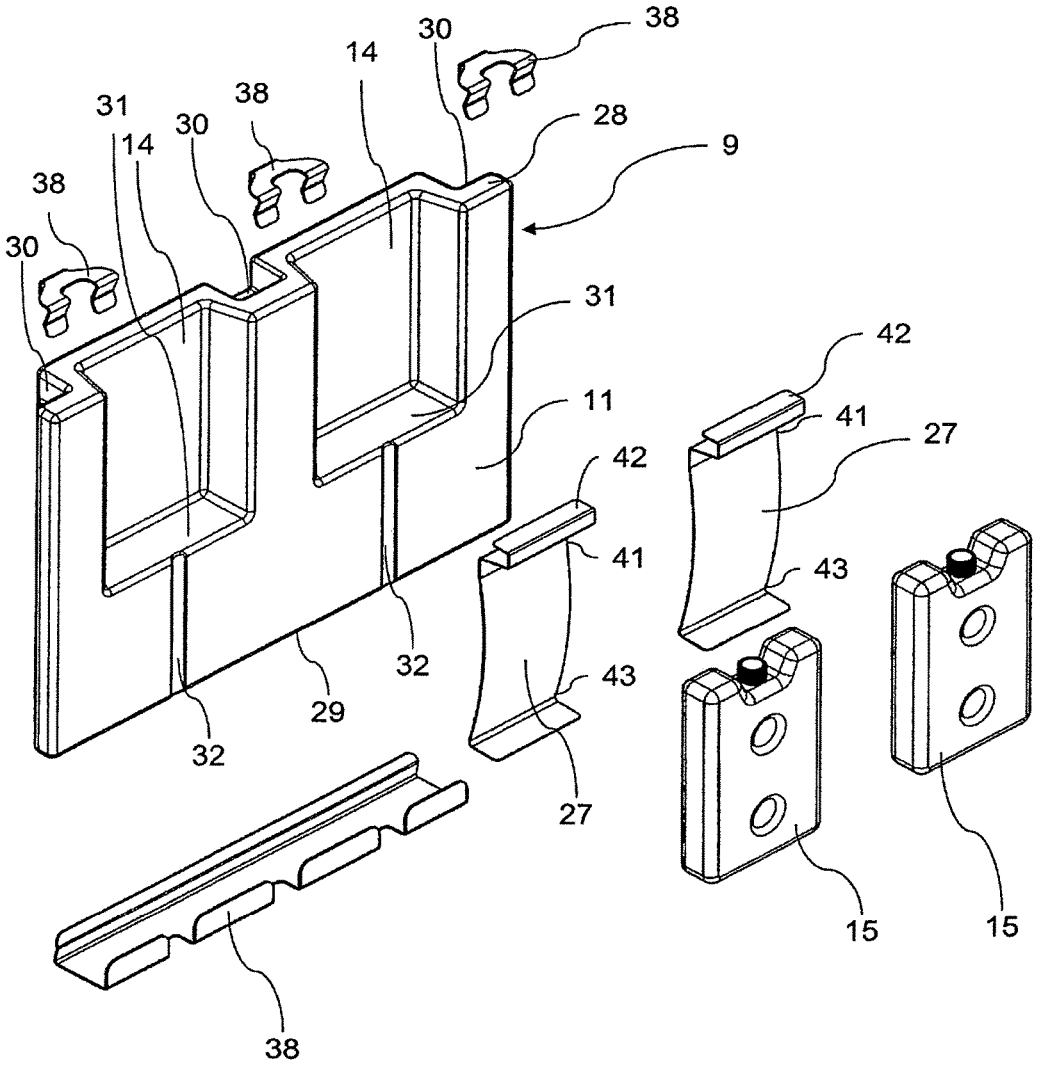
FIG. 4 shows a perspective front view of a cooling element according to the invention as well as a removable cold accumulator and a cold accumulator holder.

In FIG. 4 a cooling element 9 together with two accompanying removable cold accumulators 15 as well as cold accumulator holders 27 are illustrated. The shown embodiment of the cooling elements 9, the removable cold accumulators 15 as well as the cold accumulator holders 27 corresponds to the embodiment illustrated in FIG. 1 to FIG. 3. The cooling element 9 has two recesses 14 on the first side 11, in the present example the back 11 of the cooling element 9. In the recesses 14 each one of the two removable cold accumulators 15 together with one of the two cold accumulator holders 27 is inserted. Further, the cooling element 9 according to the invention has inclined lateral surfaces 31 and an inclined bottom surface 31 in each of the recesses 14. For each recess 14 a vertical groove 3 follows the inclined surfaces 31 on the back 11 of the cooling element 9. Here, the inclination of the inclined surfaces 31 is selected such that the condensed water collected in the recess 14 flows towards the vertical groove and can flow off through the vertical groove 32 towards the lower edge of the cooling element 29. Hereby, when freezing the cooling element 9 and the accompanying removable cold accumulators 15 an ice formation in the recess 14 in response to forming condensed water is avoided. Further, three recesses 30 can be seen on the upper edge 28 of the cooling element 9 with each of which a holding means, here in the form of a holding clamp 38, engages. The holding clamp 38 seen at the lower edge 29 of the cooling element 9 also engages with a recess 30 at the lower edge 29 of the cooling element 9 that cannot be seen in the perspective view. By means of the holding clamps 38 engaging with the recesses 30 the cooling element 9 is fixed when mounted, wherein the back 11 of the cooling element 9 faces the evaporator 5. As seen in FIG. 4, the holding clamps 38 are made of a plate such that the holding clamps 3 resiliently press the cooling element 9 against the evaporator 5 and thus, the back 11 of the cooling element 9 is in contact with the surface of the evaporator 5. Like the holding means 38 also the cold accumulator holders 27 are made of a thin plate and here, have an arc-shaped deformation from their upper end 41 to their lower end 43. Said arc-shaped deformation causes the removable cold accumulators 15 to be pressed against the evaporator 5 as soon as the removable cold accumulators 15 are inserted into the recess 14 by means of the cold accumulator holders 27. Further, the cold accumulator holders 27 at their upper end 41 have a holding portion 42 at which the user of the cooling device 1 can ergonomically grab the cold accumulator holder 27.

Figure 5:
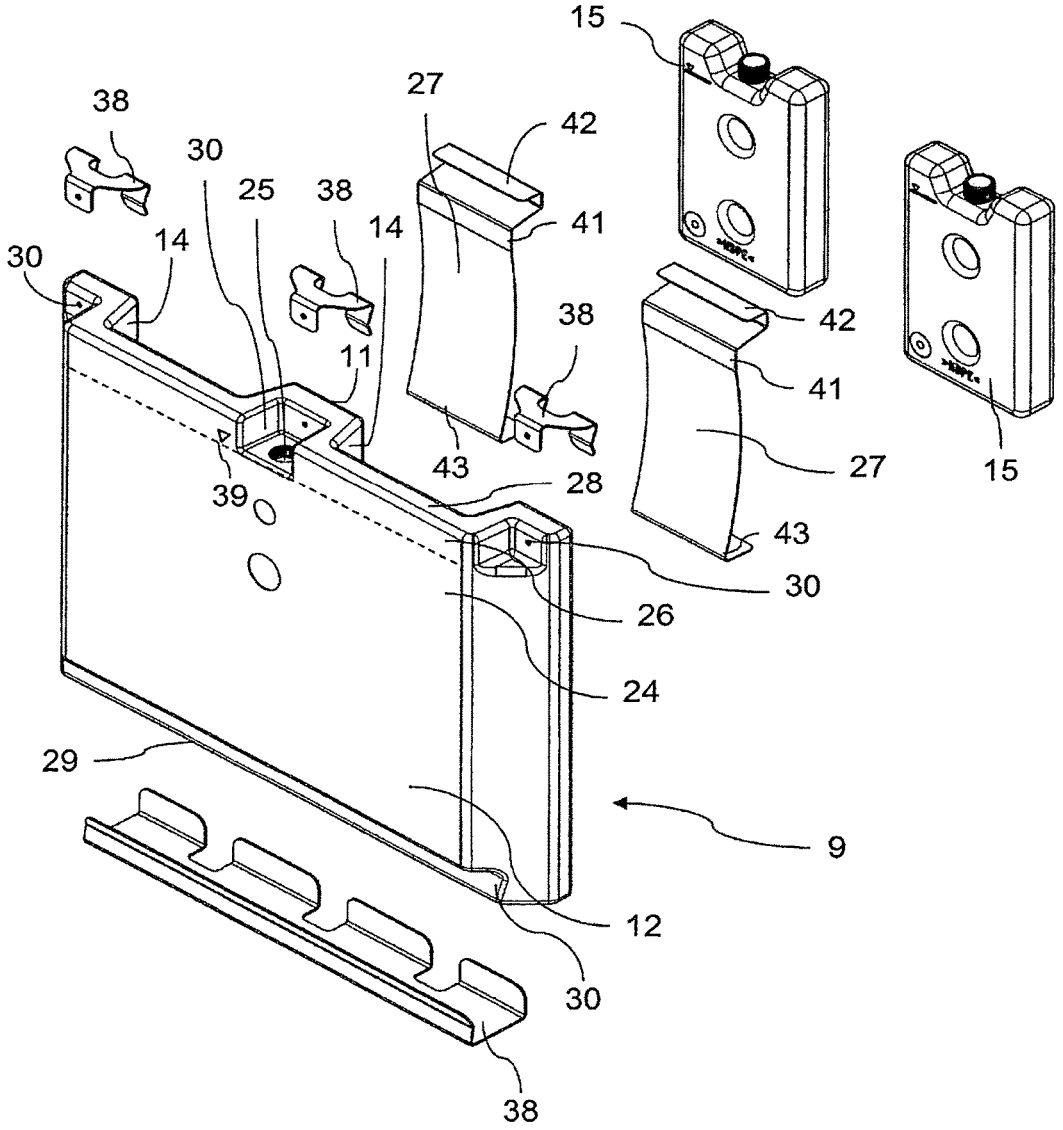
FIG. 5 shows a perspective back view of a cooling element according to the invention as well as a removable cold accumulator and a cold accumulator holder.

In FIG. 5 a cooling element 9 according to the invention together with two accompanying removable cold accumulators 15 as well as cold accumulator holders 27 are illustrated in accordance with the example described in FIG. 1 to FIG. 4, wherein in FIG. 5 the front of the cooling element 12 is shown. On the front of the cooling element 12 four recesses 30 are present with each of which a holding means 38 engages to fix the cooling element 9 on the evaporator 5. As already explained above, the cooling element 9 in the illustrated embodiment has three recesses 30 at its upper edge 28 of the cooling element 9. The recess 30 not seen in FIG. 4 at the lower edge of the cooling element 29 can now be seen in FIG. 5. Further, there can be seen the two recesses 14 present on the back 11 of the cooling element 9 that each can receive a removable cold accumulator 15 and a cold accumulator holder 27. Further, the central recess 30 of the recesses 30 arranged at the upper edge 28 of the cooling element 9 has a re-closable opening 25 through which the cooling element 9 can be filled with water or a eutectic medium 24. The reclosable opening 25 is disposed deeper than the upper edge 28 of the cooling element 9 so that a dead volume 26 is formed above the re-closable opening 25. Hereby, the maximum filling level 39 of the cooling element 9 is defined. Said dead volume 26 serves as an expansion space for the water or the eutectic medium 24 during freezing. Moreover, on the two cold accumulator holders 27 at their upper ends 41 a holding portion 42 can be seen at which the user of the cooling device 1 can ergonomically grab the cold accumulator holder 27.

Figure 6:
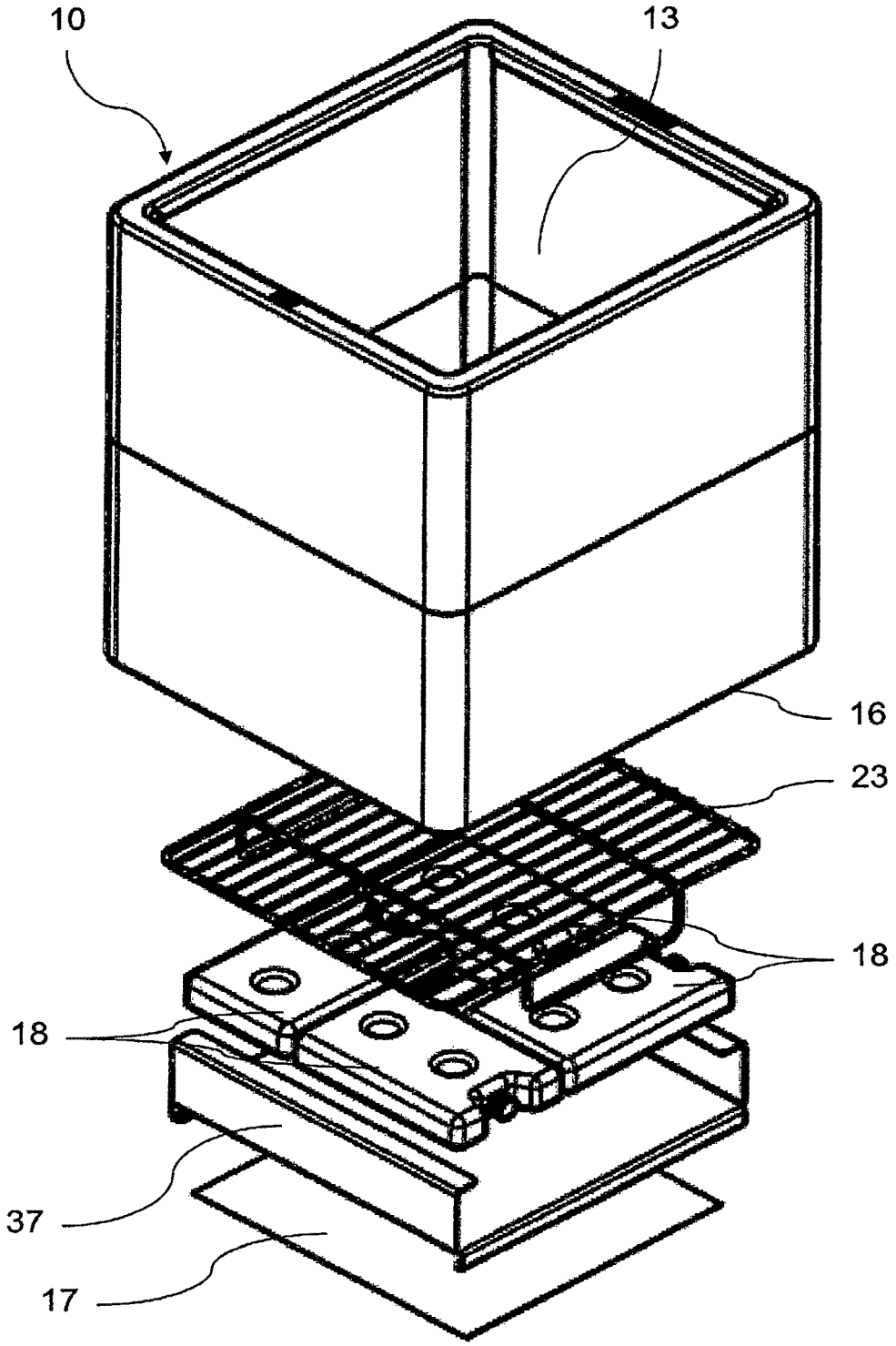
FIG. 6 shows a perspective detailed view of the insulation vessel according to the invention with heating element and storage elements.

FIG. 6 shows a detailed view of the insulating vessel 10 as well as the storage elements 18 and the heating element 17 which are arranged at the lower end 16 of the insulation vessel 10. In the illustrated embodiment, the cooling device 1 has four storage elements 18 that in case of falling below the minimum temperature in the space for cooling goods 13 emit the stored heat into the space for cooling goods 13. In order to avoid that the cooling goods 21 that are in the space for cooling goods 13 are heated too much upon contact with the storage elements 18 a spacer grid 23 is attached above the storage elements 18. In addition to the uniform tempering of the cooling goods 21 in the space for cooling goods 13 also an unauthorized removal of the storage elements 18 is prevented by the spacer grid 23. The storage elements 18 are held in the cooling device 1 in a receiving plate 37. A heating element 17 is located below the receiving plate 37. Said heating element 17, that is for example electrically operated, ensures that, as long as energy for the operation of the cooling device 1 is available, on the one hand the storage elements 18 are sufficiently charged with heat to avoid falling below the minimum temperature in the space for cooling goods 13 during the energy-free time. On the other hand, the heating element 17 ensures that falling below the minimum temperature in the space for cooling goods 13 is avoided by the evaporator 5 that is arranged around the insulation vessel in the freezing zone 19, the cooling elements 9 and the removable cold accumulators 15, as long as energy is available.

Figure 7:
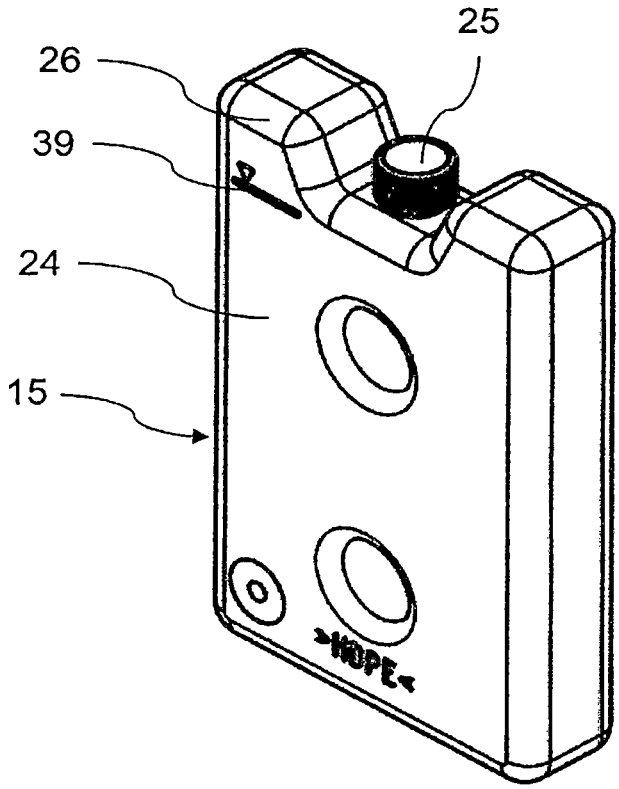
FIG. 7 shows a perspective view of a removable cold accumulator according to the invention.

In FIG. 7 a removable cold accumulator 15 according to the invention is illustrated. It can be seen that said removable cold accumulator 15 has a re-closable opening 25 through which the cold accumulator 15 can be filled with water or a eutectic medium 24. Since the re-closable opening 25 is disposed deeper than the highest point in the interior of the removable cold accumulator this results in a maximum filling height 39 that at the same time ensures that a dead volume 26 is formed above the maximum filling height 39 that functions as an expansion space during freezing of the water or the eutectic medium 24.

LIST OF REFERENCE NUMBERS

1: Cooling device
2: Freezer
3: Cooling circuit (not shown)
4: Compressor (not shown)
5: Evaporator
6: Cooling space
7: Cooling space sidewall
8: Cooling space base
9: Cooling element
10: Insulating vessel
11: First side of the cooling element
12: Second side of the cooling element
13: Space for cooling goods
14: Recess
15: Removable cold accumulator
16: Lower end
17: Heating element
18: Storage element
19: Freezing zone
20: Cooling zone (not shown)
21: Cooling goods (not shown)
22: Storage facility
23: Spacer grid
24: Eutectic Medium
25: Re-closable opening
26: Dead volume
27: Cold accumulator holder
28: Upper edge of the cooling element
29: Lower edge of the cooling element
30: Recess
31: Inclined lateral surfaces and inclined bottom surface
32: Vertical groove
33: upper edge of the cooling space
34: Covering frame
35: Openings
36: Contact surfaces (not shown)
37: Receiving plate
38: Holding means
39: Filling level
40: Lid
41: Upper end
42: Holding portion
43: Lower end
44: Condenser (not shown)
45: Freezer body

The invention claimed is:

1. A cooling device for the cooled storage of medical products, the cooler having:

a cooling circuit comprising a compressor, at least one evaporator and a condenser;

a closable cooling space with a plurality of cooling space sidewalls and a cooling space base;

at least one cooling element; and an insulation vessel;

wherein the at least one evaporator and the at least one cooling element are disposed within the cooling space;

wherein a first side of the cooling element at least partially abuts the at least one evaporator and a second side of the cooling element faces the insulation vessel;

wherein the insulation vessel is closed at least towards the at least one cooling element and forms a space for cooling goods; and wherein the first side of the cooling element abutting the at least one evaporator has at least one recess adapted to removably receive at least one removable cold accumulator.

2. The cooling device of claim 1, wherein the at least one removable cold accumulator is arranged within the at least one recess of the cooling element.

3. The cooling device of claim 1, wherein the cooling device comprises an electrical heater arranged in the region of a downwardly facing end of the insulation vessel.

4. The cooling device of claim 3, wherein the cooling device further comprises at least one heat storage element arranged in the region of the downwardly facing end of the insulation vessel.

5. The cooling device of claim 4, wherein the cooling device further comprises a spacer grid arranged to separate the space for cooling goods from the electrical heater and the heat storage element.

6. The cooling device of claim 1, wherein a region within the cooling space and outside of the space for cooling goods forms a freezing zone and the space for cooling goods formed by the insulation vessel forms a cooling zone for receiving the medical products.

7. The cooling device of claim 1, wherein the space for cooling goods further comprises a storage basket for storing the medical products and wherein the storage basket prevents contact between the medical products and the insulation vessel.

8. The cooling device of claim 1, wherein the at least one cooling element and the at least one removable cold accumulator contain a freezing substance and in which the freezing substance comprises a fluid which comprises water.

9. The cooling device of claim 1, wherein the at least one cooling element and the at least one removable cold accumulator comprise an inevitable dead volume serving as an expansion space for the freezing substance.

10. The cooling device of claim 1, wherein the cooling device further comprises a cold accumulator holder serving to insert and remove the at least one removable cold accumulator into and from the at least one recess of the at least one cooling element.

11. The cooling device of claim 10, wherein cold accumulator holder comprising a spring which resiliently holds the at least one cold accumulator against the at least one evaporator.

12. The cooling device of claim 1, wherein cold accumulator holder comprises a holding portion at its upper end for manipulation by a user.

13. The cooling device of claim 1, wherein the at least one cooling element comprises:

at least one holder recess arranged at a position selected from an upper edge and a lower edge of the cooling element; and at least one holder received in the at least one holder recess; and wherein the at least one holder holds the at least one cooling element such that at least part of a surface of the at least one cooling element resiliently abuts the at least one cooling element.

14. The cooling device of claim 1, wherein the at least one recess in the at least one cooling element for receiving the at cool accumulator has inclined lateral surfaces and an inclined bottom surface.

15. The cooling device of claim 1, wherein the first side of the cooling element has at least one vertically arranged groove for the flow off of condensed water.

16. The cooling device of claim 1, wherein the at least one cooling element is secured by a covering frame attached to an upper edge of the cooling space, and wherein the covering frame has at least one opening for access to the at least one removable cold accumulator.

17. The cooling device of claim 1, wherein, when in use to store the medical products, the temperature in the space for cooling goods is controlled to remain between +2° C. and +8° C.

18. A cooling device for the cooled storage of medical products, the cooling device having:

a cooling circuit comprising a compressor, at least one evaporator and a condenser;

a closable cooling space; and;

at least one freezable cooling element;

wherein the at least one evaporator and the at least one freezable cooling element are secured within the cooling space so as to remain within the cooling space during use of the cooling device;

wherein a first side of the freezable cooling element at least partially abuts the at least one evaporator;

wherein the first side of the freezable cooling element abutting the at least one evaporator has at least one cold accumulator recess; and wherein at least one freezable cold accumulator is removably arranged within the at least one cold accumulator recess of the freezable cooling element so that the at least one freezable cold accumulator can be frozen when arrange within the at least one cold accumulator recess and removed from the cold accumulator recess once frozen.

* * * * *